United States Patent [19]

Williams

[11] Patent Number: 4,846,690

[45] Date of Patent: Jul. 11, 1989

[54] WATER SKI TRAINING APPARATUS

[76] Inventor: Danny Williams, Rte. 10, Box 768, Lubbock, Tex. 79404

[21] Appl. No.: 77,604

[22] Filed: Jul. 24, 1987

[51] Int. Cl.[4] ..... A69B 69/18

[52] U.S. Cl. ..... 434/253; 272/97; 114/253; 441/69; 441/73; 280/818; 440/34

[58] Field of Search ..... 434/253, 247, 255; 114/242, 253; 441/68, 69, 73; 272/97; 280/809, 818, 480; 440/33, 34

[56] References Cited

U.S. PATENT DOCUMENTS

| | | | |
|---|---|---|---|
| 2,946,305 | 7/1960 | Hill | 114/253 |
| 3,042,944 | 7/1962 | Basey et al. | 114/253 X |
| 3,044,186 | 7/1962 | Berger | 272/97 X |
| 3,122,609 | 2/1964 | Moore | 114/253 X |
| 3,142,075 | 7/1964 | Hill | 114/253 X |
| 3,304,904 | 2/1967 | Spurlock | 441/69 |
| 3,390,658 | 7/1968 | Jelks | 114/242 |
| 3,422,786 | 1/1969 | Beanedhorst | 114/253 |
| 3,565,424 | 2/1971 | Macabet et al. | 272/97 X |
| 3,807,342 | 4/1974 | Turner | 114/253 |
| 4,069,786 | 1/1978 | LaBotz | 114/253 X |
| 4,392,833 | 7/1983 | Hayden | 441/69 |
| 4,460,344 | 7/1984 | Hotermann | 434/253 X |
| 4,685,413 | 8/1987 | Foreman | 114/253 |

FOREIGN PATENT DOCUMENTS 1067438 5/1967 United Kingdom .

*Primary Examiner*—Robert E. Garrett
*Assistant Examiner*—Carl D. Price
*Attorney, Agent, or Firm*—Arthur F. Zobal

[57] ABSTRACT

Two pairs of water skis are provided. A ski tow line has one end which is removably connectable to a main tow line and two connecting lines at the other end which are removably connectable to one pair of water skis. A sleeve is slideably located around the two connecting lines for movement toward or away from said one pair of water skis for adjustment of the allowable distance between the two skis of said one pair of skis. A training ski handle is provided with a tow line connected to the training ski handle and being removably connectable to the main tow line. An elongated ski handle is provided for use by the instructor and student. A tow line is connected to the elongated handle and is removably connectable to the main tow line.

13 Claims, 5 Drawing Sheets

WATER SKI TRAINING APPARATUS

BACKGROUND OF THE INVENTION

U.S. Pat. Nos. 2,946,305; 3,042,944; 3,044,186; 3,125,060; 3,422,786; 3,807,342; 4,069,786; 4,392,833; 4,460,344; 4,579,075; and British Pat. No. 1,067,488 disclose different types of water devices including some water ski training devices. All water ski training devices currently on the market are tied together in a similar manner and, in my opinion, actually provide a feeling closer to riding a sled than that of water skiing. With the skis tied together, approximately three (3) inches apart, a student is unable to move his/her skis in order to maneuver, keep his/her balance, turn, etc. The student can in fact provide no inputs to the skis in order to feel the corresponding feedback. The only steps or step in this case, that is offered by the prior art training system, is to first ski on the training skis in their tied-together method with the handle tied to the front of the skis. Next one must use a screwdriver to disconnect the four (4) eyelets that are used to hold the skis in a position about three (3) inches apart and remove the handle and rope harness. The second step is to use a regular ski rope tied to the back of the boat and attempt to ski as an adult would or any other accomplished skier. The point is, there are no progressive steps, whereby one goes from skiing on an apparatus similar to riding a sled to trying to ski like an accomplished skier. Furthermore, the handle is tied to the front of the skis. This arrangement forces the student to pull up and back on the handle rather than straight back. Additionally, the manner in which the handle is tied to the front of the skis is nonadjustable, thereby requiring an older or taller child to stoop/lean over in order to grasp the handle and a young or short child to hold the handle too high.

SUMMARY OF THE INVENTION

It is an object of the invention to provide a new water ski training apparatus for readily and properly teaching a student to water ski in a supervised, step-by-step, progressive method.

The water ski training apparatus of the invention comprises two pairs of water skis. A ski tow line is removably connectable to a main tow line and to one pair of the water skis. A first ski handle, to be held by a person, is provided. A first ski handle tow line is connected to the first ski handle and is removably connectable to the main tow line. A second ski handle is provided, which is substantially longer than that of the first ski handle and has a length sufficient such that two persons in side-by-side positions may hold onto the second ski handle with both of their hands. A second ski handle tow line is connected to the second ski handle and is removably connectable to the main tow line.

In a further aspect, two connecting lines are connected to an end of the ski tow line and are removably connectable to the two skis of said one pair of water skis. A sleeve is slideably located around the two connecting lines for movement toward and away from said one pair of water skis for adjustment of the allowable distance between the two skis of said one pair of skis.

DESCRIPTION OF THE PREFERRED EMBODIMENT

Figure 1:
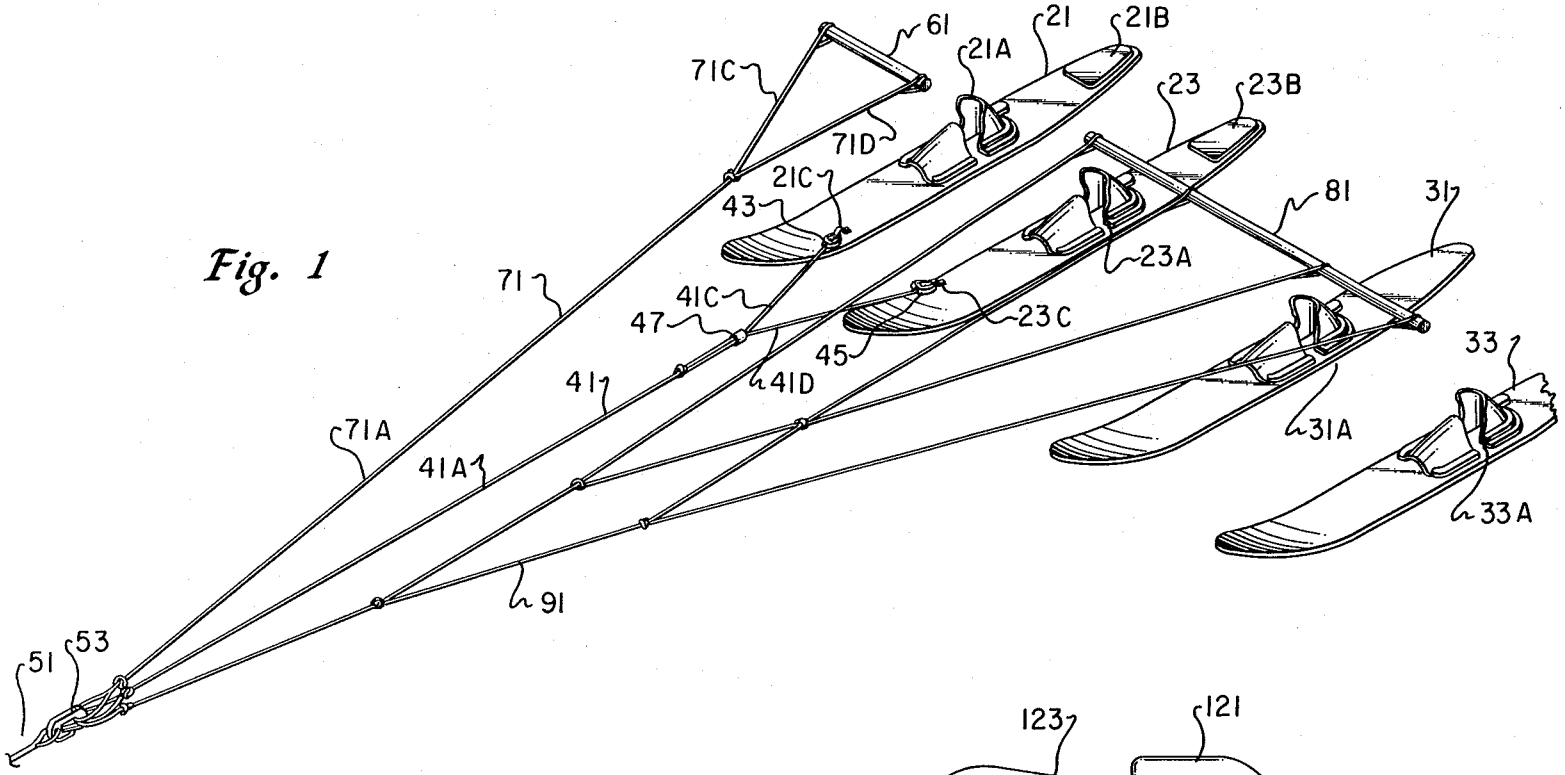
FIG. 1 illustrates the components of the water ski training apparatus of the invention.

Referring now to the drawings, the water ski training apparatus of the invention comprises a pair of water skis 21 and 23 for the student; a pair of water skis 31 and 33 for the instructor; a ski tow line 41 removably connected to a main tow line 51 and to the skis 21 and 23; a student handle 61; a handle tow line 71 connected to the handle 61 and removably connectable to the main tow line 51; an elongated handle 81 usable by the student and/or instructor; and a handle tow line 91 connected to the handle 81 and removably connectable to the main tow line 51.

Figure 10:
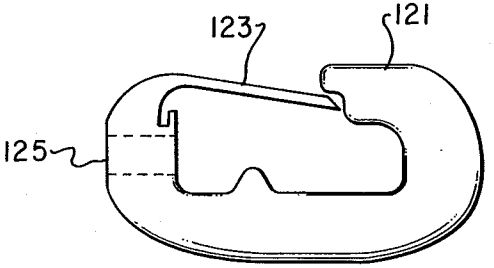
FIG. 10 illustrates a snap type coupling member which may be used on the training ski tow line in the water ski training apparatus of the invention.
Figure 2:
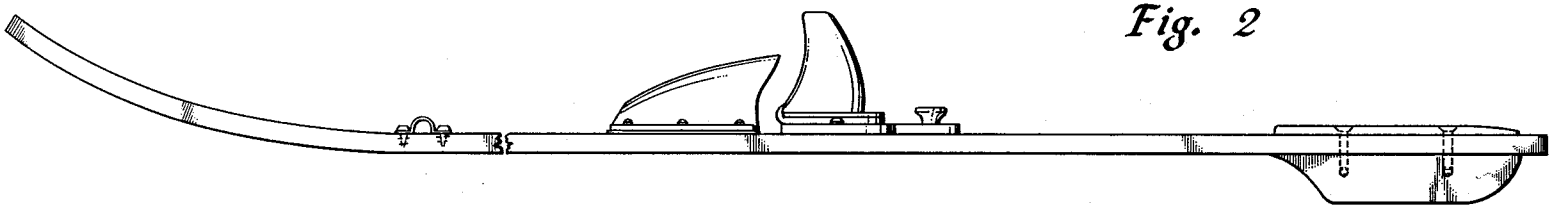
FIG. 2 illustrates a side view of one of the training skis.
Figure 3:
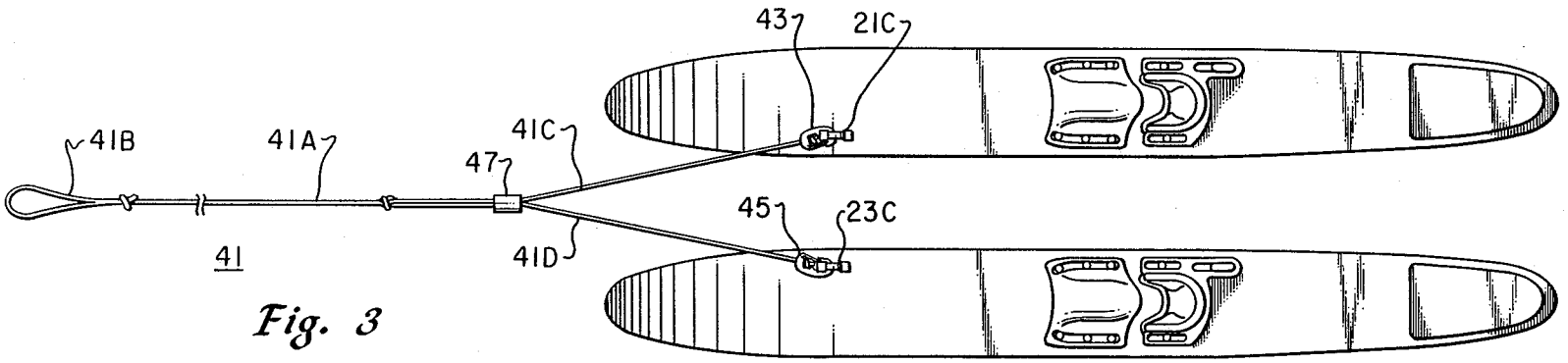
FIG. 3 is a top view of the training skis with their tow line and an adjusting sleeve in one position.
Figure 5:
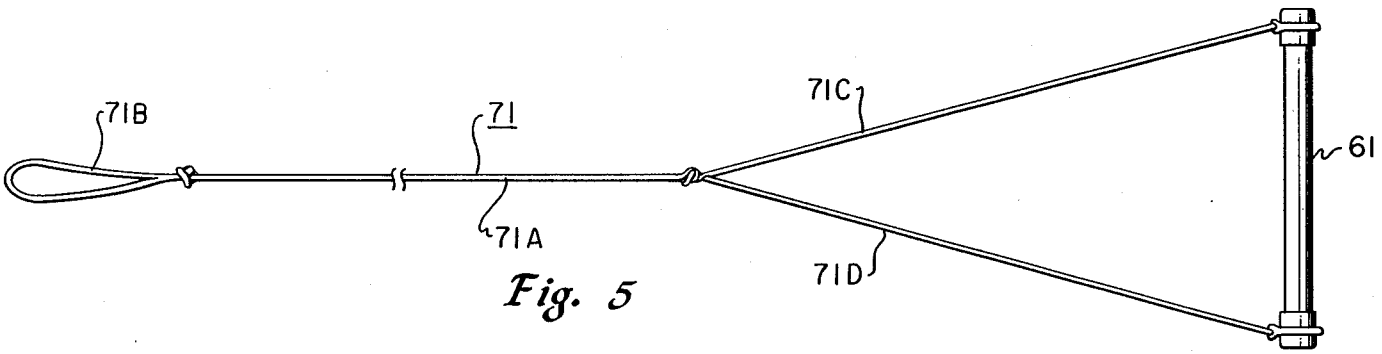
FIG. 5 is a view of a short training handle and its tow line for use by a student.
Figure 4:
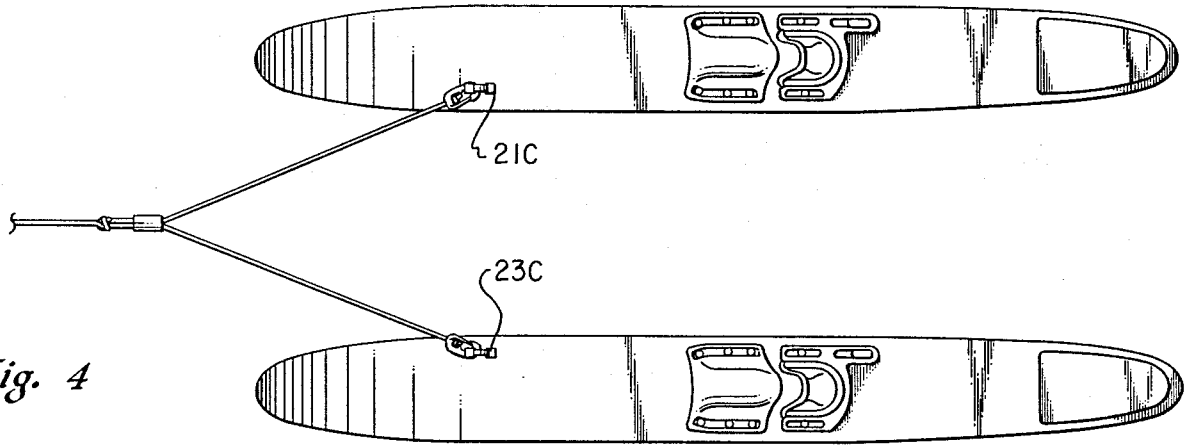
FIG. 4 is a view similar to that of FIG. 3 but with the adjusting sleeve at a different position to allow more distance between the two training skis.
Figure 6:
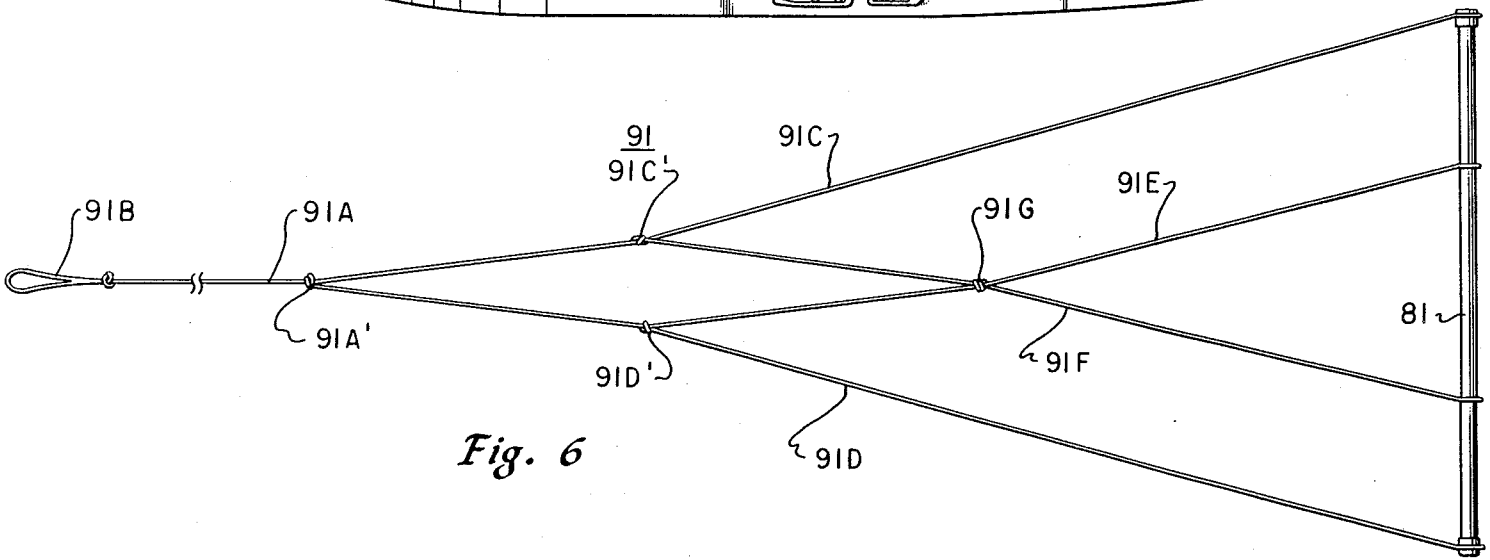
FIG. 6 is a view of an elongated training handle and its tow line to be used by both the instructor and the student.
Figure 11:
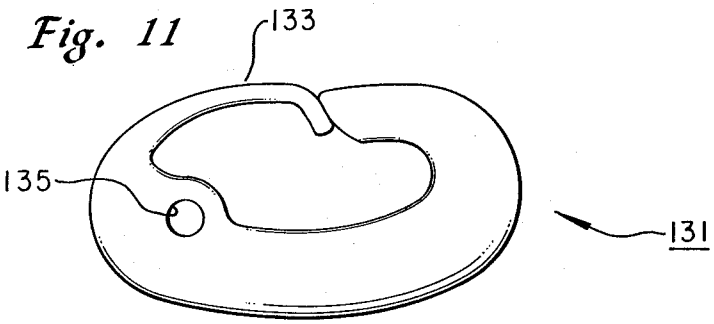
FIG. 11 illustrates a snap type coupling member which may be used in the main tow line of the water ski training apparatus of the invention.

The skis 21 and 23 and 31 and 33 are conventional water skis having flexible stirrup or binding members 21A, 23A and 31A, 33A secured to their top sides for insertion of the users feet for holding the user to the ski. The skis 21 and 23 may be of a size suitable for use by a child and the skis 31 and 33 may be of a size suitable for use by an adult. The skis 21 and 23 have been shown in their modified configuration in that they are shown with weights 21B and 23B secured to the top sides of their back ends. Furthermore, the weights could also be in the form of an extra heavy fin, i.e. lead filled plastic fin, brass fin, bronze fin or tape on lead weight, as used to balance automobile wheels. It might be noted that the addition of the weights to the rear of the child skis may not be desirable in all situations. The additional weight is intended for use when very young or small children are using the training apparatus. The additional weight may not be required by an older child who has the strength and coordination necessary to hold the skis upright, together, and parallel. Furthermore, eyelets 21C and 23C are secured of the front ends of skis 21 and 23. The end of the main tow line 51 has a snap type connector 53 of the type shown at 131 in FIG. 11 connected thereto. The connector 131 is U-shaped with a spring action movable arm 133 which is normally closed. An aperture 135 extends through one end of the connector through which a rope may be inserted and tied to the connector. The loop of another rope may be removably coupled to the connector 131 by moving the arm 133 inward to insert the loop in the bight of the connector 131 and then releasing the arm 133 to its closed position. The ski tow line 41 comprises a length of line 41A having a loop 41B formed at one end and two connecting lines 41B and 41C connected to the other end. Snap connectors 43 and 45 (of the type shown at 121 in FIG. 10) are connected to the ends of the connecting lines 41C and 41D such that they may be removably connected to the eyelets 21C and 23C. The connector 121 is U-shaped with a spring 125 extends through one end of the connector through which a rope may be inserted and tied to the connector. An eyelet may be removably coupled to the connector 121 by moving the arm 123 inward to insert the eyelet in the bight of the connector 121 and then releasing the arm 123 to its closed position. A slideable sleeve 47 is located around the two connecting lines 41C and 41D to allow adjustments of the distance between the two skis 21 and 23, as shown in FIGS. 3 and 4. The loop 41B of the ski line 41 is removably connectable to the connector 53.

The handle tow line 71 comprises a length of line 71A having a loop 71B formed at one end which may be removably connectable to the connector 53 and two connecting lines 71C and 71D connected to the other end which in turn are connected to the handle 61 at spaced apart positions.

The handle tow line 91 comprises a length of line 91A having a loop 91B formed at one end, whereby it may be removably connectable to the connector 53. Connected to the other end of the length of line 91A at point 91A' are two connecting lines 91C and 91D, which are connected to the opposite ends of the handle 81. Connected to the connecting lines 91C and 91D at points 91C' and 91D' are two intermediate connecting lines 91E and 91F. Lines 91E and 91F are connected together at 91G and their other ends are connected to the handle 81 at spaced apart points inward of the points of connection of lines 91C and 91D with the handle.

The handle 61 has a length such that one person may grasp the handle with both hands. The handle 81 has a length such that two persons may grasp the handle with both hands.

Figure 7:
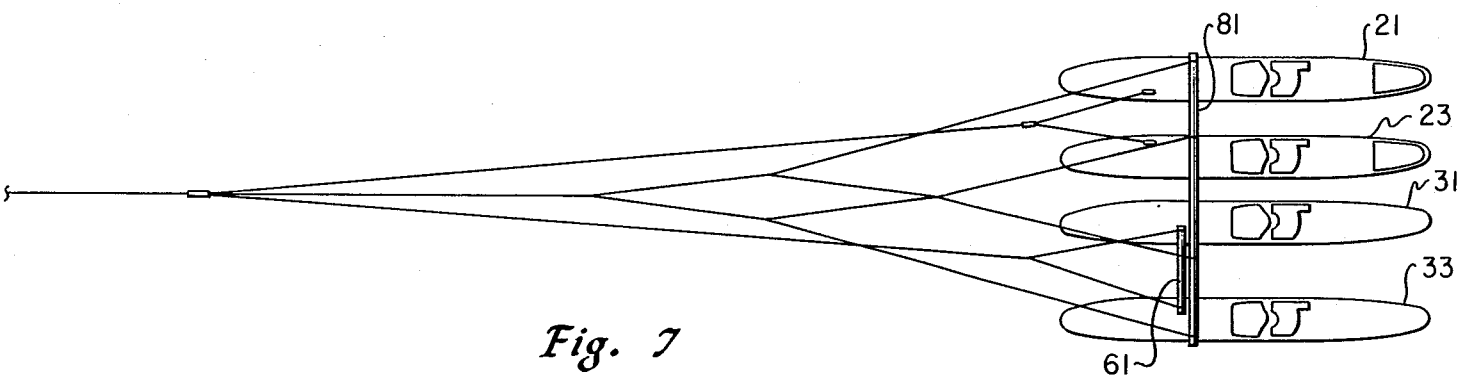
FIG. 7 is a view of the water ski training apparatus with the components in an initial training position.
Figure 8:
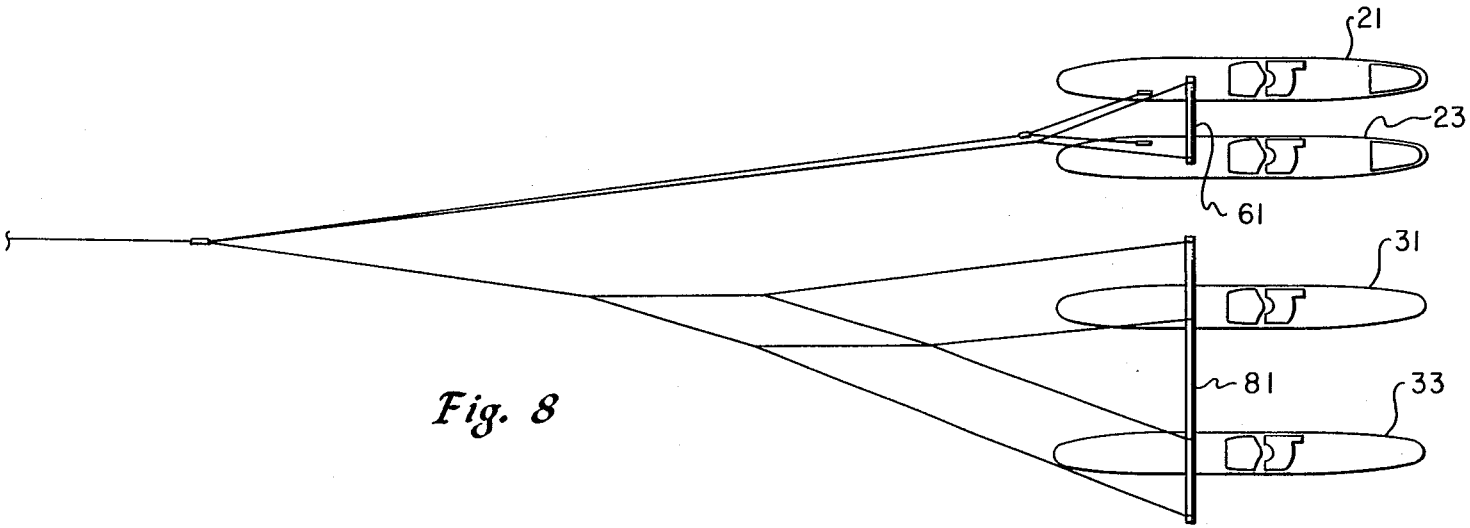
FIG. 8 is a view of the water ski training apparatus with the training handle in a position to be gripped by the student after the student gains confidence.
Figure 9:
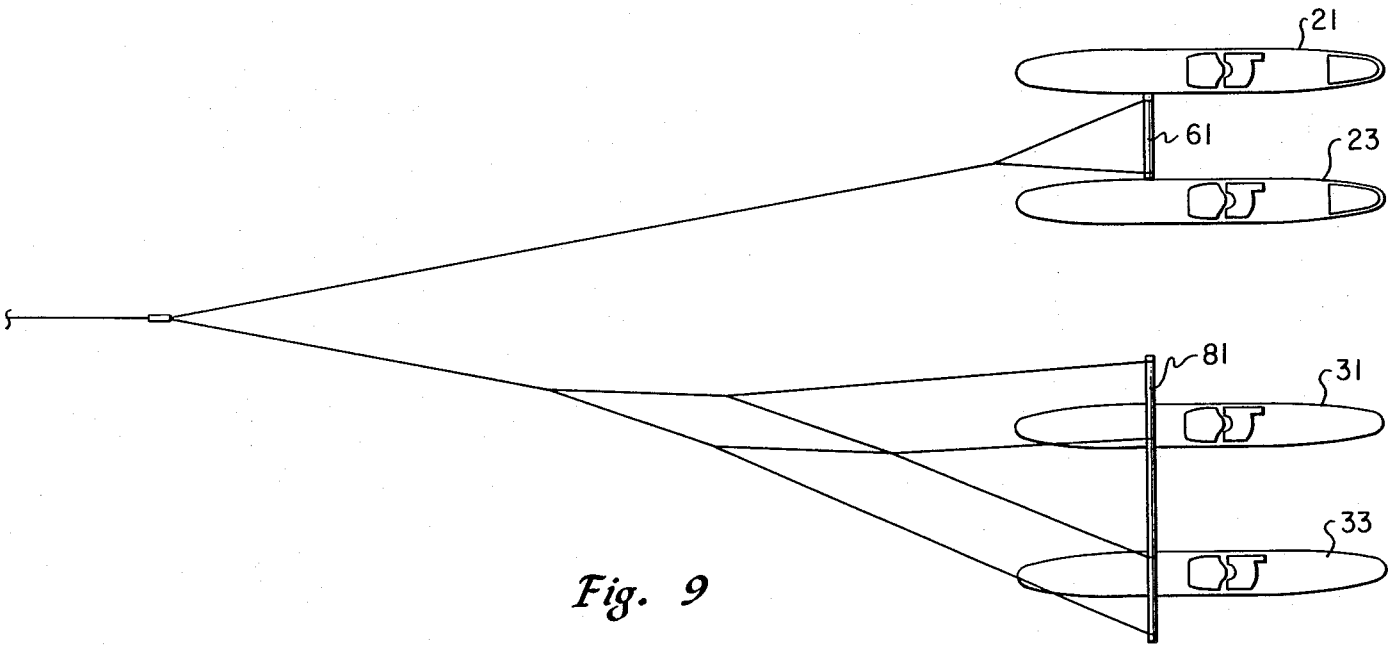
FIG. 9 is a view of a water ski training apparatus with the training ski tow line removed from the training skis whereby the student may hold on only onto the training handle.

The manner in which the water ski training apparatus may be used to train a person to ski is as follows. Assume that the student has never skied before and is a child. The main ski line 51 is attached to a tow boat and the handle 81 is attached to the main line 51 by attaching the handle tow line 91 to the connector 53 of the main ski line 51. The ski tow line 41 will be connected to the skis 21 and 23 and to the connector 53 of the tow main tow line 51. Both the student and the instructor will ski together using the same handle 81. This is done to make the student more at ease and comfortable. Before the first lesson or attempt to make a deep water start, the instructor will adjust the sleeve 47 all the way towards the skis 21 and 23 providing only about four (4) inches of freedom or distance between the skis. As the student progresses and gains experience and confidence, the sleeve 47 may be adjusted away from the skis 21 and 23 to allow for more movement of the skis by the student. As the student gains confidence, the handle 61 and the line 71 may be attached to the main ski line 51 by way of the connector 53 with both the instructor and the student holding onto the handle 81 and the instructor holding the handle 61. This is depicted in FIG. 7. Once up and at the proper speed, the instructor then passes the handle 61 to the student. This is depicted in FIG. 8. After the student is comfortable with this situation, the instructor and student can make some deep water starts with the student using the handle 61 and the instructor using the handle 81. While all of this is taking place, the student is learning how to control his/her skis and gaining the knowledge and experience necessary to solo. The next step is to disconnect the ski tow line 41 from the skis 21 and 23 and from the main tow line 51 and place it in the boat. This can be accomplished rapidly due to the use of the quick-connect, quick-disconnect, connectors 53 and 43 and 45. Now the instructor can let the student solo beside the instructor. This is depicted in FIG. 9.

Thus, by using the ski training apparatus of the invention, the student and instructor can add or remove an accessory in a matter of seconds, i.e. the handle 61, the handle 81, or the ski tow line 41. As a matter of fact, when it is time to solo, the student and the instructor can have the skis disconnected in a matter of seconds using the connectors 43 and 45 and 53 that are provided. One can reattach the skis for the purpose of training just as quickly and easily. This can be done while in the water without the fear of losing anything.

In one embodiment, the handle 61 has a length of twelve (12) inches and the handle 81 has a length of forty (40) inches. The ski tow line 41 may have a total length of nine (9) feet six (6) inches. The handle tow line 71 may have a total length of ten (10) feet and the handle tow line 91 may have a total length of ten (10) feet. The distance from the end of the loop 91B of the handle tow line 91 to the point 91A' the line 91A may be three (3) feet. The main tow line 51 may have a length of about thirty (30) feet to sixty-five (65) feet with a six (6) inch loop at one end and the connector 53 at the other end. The connecting lines 41C and 41D each may have a length of two (2) feet. The sleeve 47 may be a 3/16 inch inside diameter plastic hose. The connectors 53, 43, and 45 are commercially available plastic connectors. The skis 21 and 23 may be youth skis each having a length of forty-seven (47) inches to fifty (50) inches with fins on their rear undersides. The weights 21B and 23B, or another configuration thereof, may be approximately ten (10) ounces. The weight may differ depending on the buoyancy of the pair of skis 21 and 23, i.e. wood skis would require more weight than fiberglass skis. The skis 31 and 33 also may have fins on their rear undersides. If the student is an adult, the skis 21 and 23 may have lengths suitable for adults. The ski lines and tow lines may be made out of a suitable plastic rope material, such as polypropolyne.

The handle 81 may have a length greater or less than forty (40) inches. The manner in which the tow line 91 is shown connected to the handle 81 is preferred since it provides more stability. Although providing less stability, the tow line 91 may be connected to the handle 81 at only two points (to the opposite ends of the handle 81) or at only one point (the middle of the handle 81).

I claim:

1. A water ski training apparatus, comprising:

two pairs of water skis, a ski tow line comprising a length of line having a first end with means for removably connecting said first end of said ski tow line to a main tow line, said length of line of said ski tow line having a second end with two connecting lines connected to said second end at a given position, said two connecting lines having separate connecting means respectively for removable connecting said two connecting lines to the two skis respectively of one of said pairs of water skis, said two connecting lines of said ski tow line being connected to said second end of said length of line of said ski tow line at said given position in a manner to prevent the lengths of said two connecting lines between said given position and their said separate connecting means respectively from changing while said apparatus is in use, a first ski handle, to be held by a person, a first ski handle tow line connected to said first ski handle, said first ski handle tow line having an end with means for removably connecting said end of said first ski handle tow line to the main tow line, a second ski handle substantially longer than said first ski handle, said second ski handle having a length sufficient such that two persons in side-by-side positions may hold onto said second ski handle with both of their hands, and a second ski handle tow line connected to said second ski handle and having an end with means for removably connecting said end of said second ski handle tow line to the main tow line.

2. The apparatus of claim 1, comprising:

sleeve means slideable around said two connecting lines toward said one pair of water skis and away from said second end of said ski tow line or away from said one pair of water skis and toward said second end of said ski tow line for adjustment of the allowable distance between the two skis of said one pair of skis.

3. The apparatus of claim 2, comprising:

four connecting lines connected to said second ski handle tow line and to said second ski handle at spaced apart positions to allow two persons or one person to hold onto said second ski handle for skiing purposes.

4. The apparatus of claim 1, comprising:

four connecting lines connected to said second ski handle tow line and to said second ski handle at spaced apart positions to allow two persons or one person to hold onto said second ski handle for skiing purposes.

5. The apparatus of claim 2, wherein:

said two connecting lines are removably connected to the two skis of said one pair of water skis.

6. The apparatus of claim 1, comprising:

a main tow line, said first end of said length of line of said ski tow line being removably connected to said main tow line and said two connecting lines of said ski tow line being removably connected to the two skis respectively of said one pair of water skis, said first ski handle tow line being removably connected to said main tow line, said second ski handle tow line being removably connected to said main tow line.

7. The apparatus of claim 6, comprising:

four connecting lines connected to said second ski handle tow line and to said second ski handle at spaced apart positions to allow two persons or one person to hold onto said second ski handle for skiing purposes.

8. A water ski training apparatus, comprising:

a pair of water skis, a ski tow line comprising a length of line having a first end with means for connecting said first end of said ski tow line to a main tow line, said length of line of said ski tow line having a second end with two connecting lines connected to said second end at a given position, said two connecting lines having separate connecting means respectively for removably connecting said two connecting lines to the two skis respectively of said pair of water skis, said two connecting lines of said ski tow line being connected to said second end of said length of line of said ski tow line at said given position in a manner to prevent the lengths of said two connecting lines between said given position and their said separate connecting means respectively from changing while said apparatus is in use, a first ski handle, to be held by a person, a first ski handle tow line connected to said first ski handle, said first ski handle tow line having an end with means for removably connecting said end of said first ski handle tow line to the main tow line, a second ski handle substantially longer than said first ski handle, said second ski handle having a length sufficient such that two persons in side-by-side positions may hold onto said second ski handle with both of their hands, and a second ski handle tow line connected to said second ski handle and having an end with means for removably connecting said end of said second ski handle tow line to the main tow line.

9. The apparatus of claim 8, comprising:

sleeve means slideable around said two connecting lines toward said pair of water skis and away form said second end of said ski tow line or away from said pair of water skis and toward said second end of said ski tow line for adjustment of the allowable distance between the two skis of said pair of skis.

10. The apparatus of claim 9, comprising:

four connecting lines connected to said second ski handle tow line and to said second ski handle at spaced apart positions to allow two persons or one person to old onto said second ski handle for skiing purposes.

11. The apparatus of claim 9, wherein:

said two connecting lines are removably connected to the two skis of said pair of water skis.

12. The apparatus of claim 8, comprising:

four connecting lines connected to said second ski handle tow line and to said second ski handle at spaced apart positions to allow two persons or one person to hold onto said second ski handle for skiing purposes.

13. The apparatus of claim 8, comprising:

a main tow line, said first end of said length of line of said ski tow line being removably connected to said main tow line and said two connecting lines of said ski tow line being removably connected to the two skis respectively of said pair of water skis, said first ski handle tow line being removably connected to said main tow line.

* * * * *